United States Patent [19]

Hottenroth et al.

[11] Patent Number: 4,471,751

[45] Date of Patent: Sep. 18, 1984

[54] COMPACT STOVE FOR EMERGENCY AND OTHER USES

[76] Inventors: Fred W. Hottenroth, 1740 Interlachen St., Seal Beach, Calif. 90740; Fred W. Hottenroth, III, 411 S. Country Hill Dr., Anaheim, Calif. 92807

[21] Appl. No.: 313,480

[22] Filed: Oct. 21, 1981

[51] Int. Cl.[3] ..... A47J 37/07; F24B 3/00

[52] U.S. Cl. ..... 126/25 R; 126/15 R; 126/77

[58] Field of Search ..... 126/77, 146, 15 R, 15 A, 126/9 R, 9 A, 29, 11, 38, 43, 44, 59, 59.5, 58, 25 R, 80, 121, 123, 261, 262, 265, 224, 67; 431/33

[56] References Cited

U.S. PATENT DOCUMENTS

| | | | |
|---|---|---|---|
| 119,718 | 10/1871 | Rand | 126/77 |
| 1,074,194 | 9/1913 | Pascoe | 126/67 X |
| 2,114,698 | 4/1938 | Babin | 126/25 A |
| 2,383,188 | 8/1945 | Griswold | 126/77 X |
| 2,414,147 | 1/1947 | Fleer | 126/77 |
| 2,419,379 | 4/1947 | Tindell | 126/77 X |
| 2,488,014 | 11/1949 | Higman | 126/9 A X |
| 2,936,724 | 5/1960 | Bishop | 126/77 X |
| 4,019,492 | 4/1977 | Rush | 237/51 X |
| 4,094,295 | 6/1978 | Boswell et al. | 126/9 R X |
| 4,369,761 | 1/1983 | Burnette | 126/67 X |

*Primary Examiner*—Samuel Scott

*Assistant Examiner*—Kenichi Okuno

*Attorney, Agent, or Firm*—K. H. Boswell; Edward D. O'Brian

[57] ABSTRACT

A small compact stove capable of burning a variety of carbonaceous fuels has a base and located on the base is a vertically oriented cylindrical wall. The wall is formed of a heat conducting material and has open bottom and top ends. The interior surface of a portion of the wall forms a combustion chamber. A grate is located within the wall at the bottom end of the combustion chamber. The primary air chamber is located at the open bottom end of the wall and primary air is conducted through it and then up through the grate into the combustion chamber. A secondary air chamber surrounds at least a portion of the wall such that the wall forms one of the surfaces of the secondary air chamber. The wall includes a plurality of air passageways between the secondary air chamber and the combustion chamber such that air can flow within the secondary air chamber in contact with the exterior surface of the wall and be heated by heat conducted through the wall from the combustion chamber. The heated air from the secondary air chamber then flows through the passageways into the combustion chamber. The stove is capable of burning solid, liquid and gaseous carbonaceous fuel by appropriately adapting the grate to support either the solid fuel or a container having a suitable surface for burning of liquid and gaseous fuels.

14 Claims, 8 Drawing Figures

COMPACT STOVE FOR EMERGENCY AND OTHER USES

BACKGROUND OF THE INVENTION

This invention is directed to a stove capable of burning a variety of carbonaceous fuel. The stove is completely self-contained and requires no blowers or the like, and thus is suitable for emergency use, outdoor use and for use in societies not supplied with the more convenient forms of energy. The stove includes a vertically oriented wall which serves both as a combustion chamber and a heat exchanger for preheating combustion air.

Man's use of fire dates to antiquity; however, this use has not always been effective and efficient use of the fuel sources available to him. With the invention of the chimney man was able to more effectively control both the rate of burning and the direction of heat output of his fire. With the advent of a forced draft, man was better able to control the efficiency of his fire. The chimney, however, requires a fixed fireplace which is generally totally immobile. Forced draft requires expenditure of some sort of energy to drive the blower whether it be human muscle powered as with a bellows, or electrical energy as with a fan.

In certain emergency situations such as the total loss of any utility service, airplane crashes and the like, the availability of the chimney or forced draft is totally precluded. Further, in certain areas of the world which bear the burden of a very large population and little or dwindling natural biomass resources, fuel is a very precious commodity which cannot afford to be wasted or used inefficiently. Along with a shortage of biomass fuel these same areas suffer from a lack of any central utility service for supplying electrical or petroleum based fuels more commonly found in the industrialized countries.

The cast iron stove, such as the Franklin stove, served the needs of the industrialized countries prior to the industrial revolution. Unfortunately the lack of natural resources or the lack of energy to utilize natural resources prevent the utilization of cast iron stoves in most of the third World countries at this time. Additionally such stoves are quite heavy and therefore not portable, and would not serve the needs as an emergency stove nor a stove suitable for camping and the like.

In the industrialized countries of the world modern portable stoves rely on either the use of cylinders of compressed gas, or fuel delivery systems which require pumps and the like to create an internal pressure within a fuel reservoir. These stoves suffer from several defects including the economics of the system, the complexity of the systems, and the requirement for very specific fuels. As such, they are totally unsuitable for use in less developed countries or use in those situations where very specific fuels are not available.

It is evident from the above discussion that there exists a need for an efficient stove which requires no chimney, no use of any forced draft appliances, can burn a variety of carbonaceous fuels, and is small, lightweight, portable and extremely simple in manufacture and operation.

BRIEF DESCRIPTION OF THE INVENTION

It is a broad object of this invention to provide a stove of the type described in the previous paragraph. It is a further object to provide a stove which can be manufactured essentially totally by hand, and thus could be produced in areas of the world not having any existing manufacturing facilities. It is a further object to provide a stove which, because of its simple construction and operation can be manufactured in an extremely efficient and economical manner such that it would be available to the large populations of certain underdeveloped countries. It is a further object of this invention to provide a stove which can be utilized for both cooking and space heating and thus could serve as an emergency stove in certain situations, and as the primary appliance of certain civilizations.

These and other objects as will become evident from the remainder of this specification are achieved in a carbonaceous fueled heating device which comprises: a base; a vertically oriented, heat conducting, continuous wall located on said base, said wall having an interior surface and exterior surface, said wall having open top and bottom ends, at least a portion of the interior surface of said wall forming a combustion chamber; a grate means located within said combustion chamber proximal to said bottom end; a primary air supply means located in said base below said combustion chamber, said bottom end of said wall opening into said primary air supply means such that said air is capable of flowing from said primary air supply means through said open bottom end of said wall into said combustion chamber; a secondary air supply means, at least a portion of said secondary air supply means being located around said wall, said wall including a plurality of air passageways between said secondary air supply means and said combustion chamber such that air can flow within said secondary air supply means and contact said exterior surface of said wall and be heated by heat conducted from said combustion chamber by said wall and flow through said passageways into said combustion chamber.

In the preferred embodiment of the invention the primary air supply means would include a primary air chamber means located within the base and having a primary air inlet means such that air from the ambient environment could flow through the inlet means into the primary air chamber means. Further, the secondary air supply means would include a secondary air chamber means, at least a portion of which is formed by the exterior surface of said wall. The secondary air chamber means would include a secondary air inlet means connecting to the ambient environment allowing for air flow through the secondary air inlet means into the secondary air chamber means.

In the preferred embodiment the secondary air chamber means would include a continuous second wall which is spaced from and surrounds at least a portion of said wall forming a secondary air heat exchange chamber between the wall and the second wall. This second wall could be formed of an insulating material generally capable of retarding heat transfer through itself inhibiting heat loss through this second wall.

In the preferred embodiment of the invention the grate would be upwardly displaced from the bottom end of the wall such that a portion of the wall would extend above the grate forming the combustion chamber and the remaining portion would extend below the grate. The interior surface of the portion below the grate would form a primary air heat exchanger chamber capable of transferring heat to primary air flowing from the primary air chamber means upwardly through the grate. The passageways located in the wall would be located in that portion of the wall above the grate. Both the primary and second air inlet means could include a damper means capable of regulating flow of air between the ambient environment and the respective primary and secondary air chamber means.

In the preferred embodiment of the invention both the wall and the second wall would be cylindrical in shape and would be located in a coaxial relationship with one another, and would further include a cap means located at their top and extending between them such that the cap means forms the uppermost portion of the secondary heat exchange chamber.

The heating device could include a primary baffle means located in the primary air chamber means and capable of introducing a torsional flow component into air moving within the primary air chamber means. Futher, the heating device could include a secondary baffle means located in the secondary air heat exchange chamber and capable of introducing a torsional flow component into the air moving within the secondary air heat exchange chamber.

Further, the heating device could include a tube means, at least a portion of which is heat conducting and at least a portion of which is located vertically in the secondary air heat exchange chamber. A further portion of the tube means would extend through the wall near its top end into the combustion chamber. A water supply means would be connected to the tube means to supply water to the interior of the tube means and a heat absorbing means would be located within the secondary heat exchange chamber and attached to the tube means in such a manner that heat can be conducted from the heat absorbing means to the tube means to heat and boil water located within the tube means. Preferredly the heat absorbing means would comprise at least one heat conducting ring located within the secondary air heat exchange chamber.

Preferably the wall of the heating device would be appropriately suspended such that any heat conducting surfaces to which it is attached are utilized as heat radiating surfaces for either preheating both primary and secondary air, or as heat radiating surfaces of the device itself. Preferably the base of the device is so constructed that there is minimal contact of the base of the device with any supporting surface, thus minimizing heat loss from the base to that supporting surface. In one embodiment of the invention a fuel delivery tube can be incorporated on the device to conduct fuel through both the wall and the second wall from a point exterior of the device to a point over the grate. In another embodiment of the invention a multiple heat outlet housing could be located on top of the device to provide a heating space for heating of a plurality of cooking utensils or the like.

BRIEF DESCRIPTION OF THE DRAWINGS

The invention described in this specification will be better understood when taken in conjunction with the drawings wherein.

Figure 3:
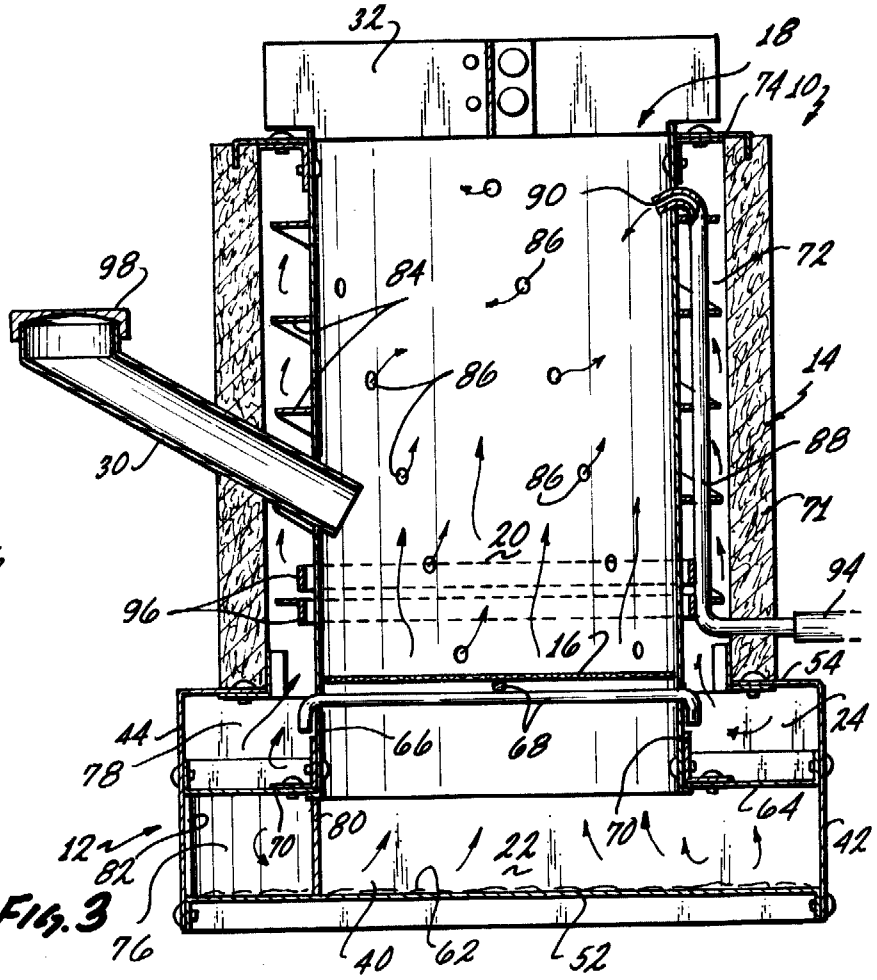
FIG. 3 is a side elevational view in section about the line 3—3 of FIG. 1.

The invention described in this specification and illustrated in the drawings utilizes certain principles and/or concepts as are set forth in the claims appended to this specification. Those skilled in the heating arts will realize that these principles and/or concepts are capable of being utilized in a variety of embodiments differing from the illustrated embodiments herein. For this reason this invention is not to be construed as being limited to the exact illustrated embodiments, but is to be construed only in light of the claims.

DETAILED DESCRIPTION

The heating device of this invention, hereinafter called the stove 10, as seen in the figures has a base 12 and an upper cylindrical section 14. With the exception of two knobs hereinafter identified and the outside surface of the upper cylindrical section 14 the remainder of the stove 10 is formed of simple sheet metal structures which can be cut, bent and attached together utilizing very simple construction methods. The sheet metal plates and the like as seen in the figures and hereinafter described can be cut with tin snips or can be stamped out of suitable sheet stock. These are appropriately joined together utilizing rivets, sheet metal screws or other simple joiners or fasteners. The materials can be bent by hand using simple forming tools or can be bent across jigs or the like. The two knobs noted above can be formed of any simple non-heat conducting material, such as wood or the like. The outer portion of the upper cylindrical sleeve 14 can be formed of any insulating material or other suitable materials such as ceramics, glasses and the like.

Figure 6:
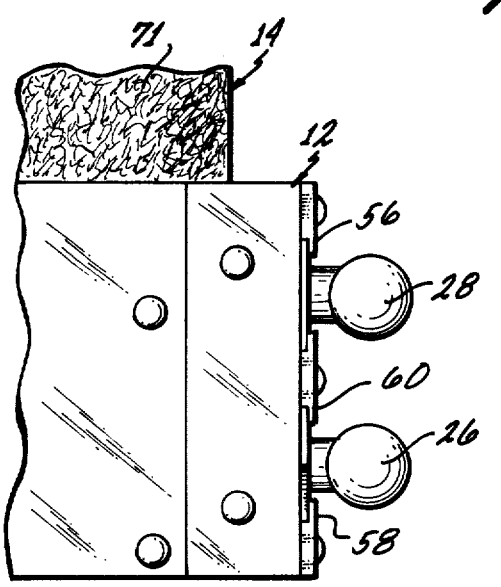
FIG. 6 is a side elevational view of a portion of the base area of the device.
Figure 5:
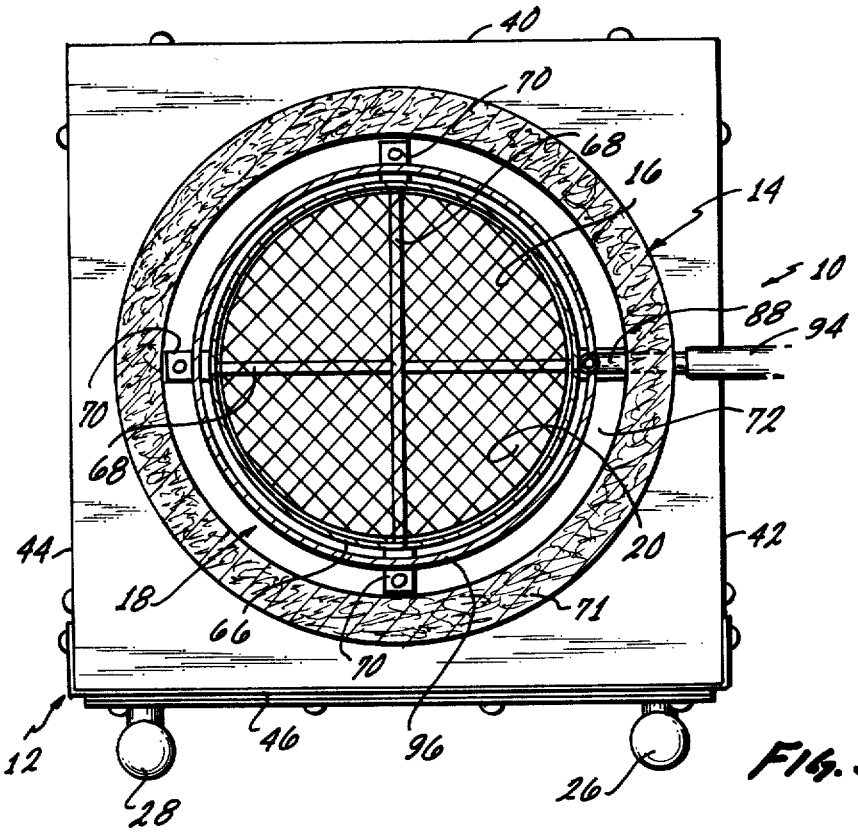
FIG. 5 is a plan view in section about the line 5—5 of FIG. 2.
Figure 7:
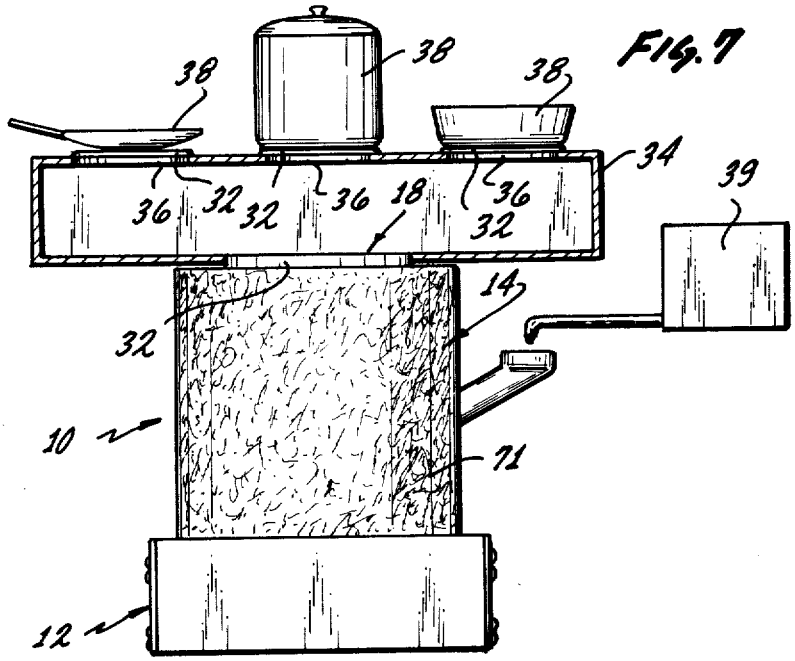
FIG. 7 is a side elevational view in partial section of an alternate embodiment of the device seen in FIG. 1.

FIGS. 1 through 6 and FIG. 8 illustrate the preferred embodiment of the invention. In FIG. 7 an embodiment is shown which illustrates two principles which can be utilized to modify the primary embodiment of the invention.

For use with a solid carbonaceous fuel the stove 10 would be equipped with an open grate 16. This open grate 16 is capable of supporting a variety of solid fuels, such as pine cones, dung, grasses, wood chips, compressed wood, fuel pellets and the like. The exact type and source of fuel would depend upon the location in which the stove is used. Assuming the use of large piece size fuel, the fuel would be passed through the top opening 18 of the combustion chamber 20. The stove 10 is equipped with a primary air damper 22 and a secondary air damper 24. The fuel within the combustion chamber 20 is ignited and the air flow to efficiently burn this fuel is adjusted via the two dampers 22 and 24. Each of the dampers have attached thereto a heat insulated knob 26 and 28, respectively, which assures that the user of the stove 10 does not burn his fingers when adjusting the dampers.

For use with certain fuels the loading tube 30 could be utilized. The loading tube 30 passes through the upper cylindrical section 14 and leads directly over the grate 16. Small size solid fuel such as fuel pellets, granulated wood or biomass products can be easily introduced through the loading tube 30 directly onto the grate. The loading tube 30 allows for additional fuel to be added to the combustion chamber 20 without having to remove a utensil or the like from atop of the utensil supporting member 32.

The utensil supporting member 32 appropriately holds a cooking utensil or the like above the top opening 18 and is spaced away from this top opening 18 such that hot gases from the combustion chamber can contact the bottom of the utensil, flow along its bottom and then up its side edges to very efficiently and effectively heat the utensil. Once combustion has started within the combustion chamber certain components located therein are warmed by the combustion process itself and these components are utilized to preheat both primary and secondary air. After initial combustion has warmed these components adjustment of the primary and secondary air dampers 22 and 24 might not be effected to control the rate of heating within the combustion chamber 20. Adjustment of the primary and secondary air dampers 22 and 24 also allows for variability of fuels used within the stove 10.

Certain fuels as they are heated are vaporized in part to combustible gases. Secondary air, which as seen below, is introduced above the grate 16 and is utilized to assure complete combustion of these combustible gases. When such fuels are used the secondary air damper would be appropriately adjusted to insure that adequate air for combustion was introduced into the combustion chamber 20. Other fuels such as charcoal and the like do not require as much secondary air as would the above described fuel. For use with fuels such as charcoal the secondary air damper would be appropriately positioned such that secondary air flow would be reduced with respect to primary air flow. Adjustment of the dampers 22 and 24 will be more fully understood when taken in conjunction with the internal structure of the stove 10 as outlined below.

Figure 1:
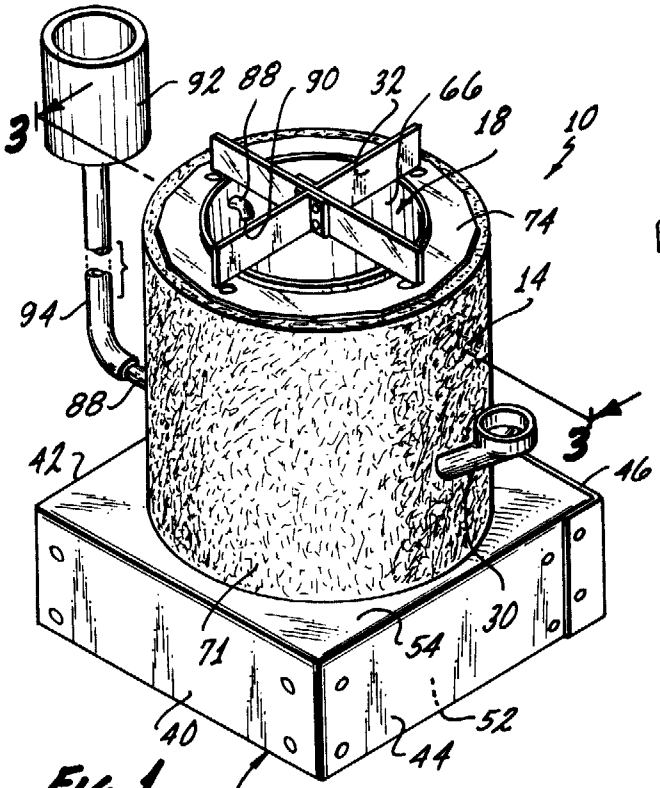
FIG. 1 is an oblique view of the back, one side and the top of the heating device of this invention.

Shown in FIG. 7 is a modified form of the invention which utilizes a chamber 34 which is mounted or placed on top of the stove 10. The chamber 34 has a plurality of ports collectively identified by the numeral 36 on which a plurality of utensils, collectively identified by the numeral 38, can be placed. Each of these ports 36 can include a utensil supporting member 32 as is shown in FIG. 1 but not included in FIG. 7. In any event the heat from the combustion chamber 20 is utilized in the embodiment of FIG. 7 to heat a plurality of individual utensils 38.

Also shown in FIG. 7 is the use of a liquid carbonaceous fuel container 39 which is shown to drip a controlled amount of liquid fuel into the loading tube 30 for passage into the combustion chamber 20. When so utilizing a liquid fuel, a small shallow container filled with sand or the like could be placed on top of the grate 16 such that the liquid fuel drips down from the loading tube 30 into the sand and is permeated through the sand with a portion of it vaporizing from the surface of the sand to provide the fuel for combustion within the combustion chamber 20. When so used the stove 10 could be fueled by a variety of any liquid carbonaceous fuels such as diesel oil and the like. The liquid fuel dispenser does not form a part of this invention, but could be any one of a variety of drip systems which are known, such as those metering liquid fuel to pottery kilns and the like. The liquid fuel delivery system would be chosen to accommodate the particular liquid fuel used. Additionally, gaseous fuel which is denser than air could be utilized by extending the loading tube 30 directly into a bed of sand or the like held in a shallow cup as per the liquid fuel. Appropriate simple gas jets or the like could be led into the bottom of such a sand filled container for use with gaseous fuel which is less dense than air. A porous lava rock such as that utilized in a natural gas fueled barbecue could serve as a suitable matrix surface for combustion of a gaseous fuel within the combustion chamber 20.

It is evident from the above that the stove 10 is capable of utilizing a variety of available fuels. It is primarily designed to burn solid biomass which is more readily available in primitive or overpopulated environments. The stove 10, however, burns this fuel in such a manner that the heat content of the fuel is more efficiently extracted from the fuel. In any event, the stove 10 is capable of supplying the burning fuel with a sufficient amount of air to completely support combustion therein. The conversion of carbon based fuel to carbon monoxide is extremely inefficiently in the amount of btu's liberated with respect to the complete conversion of this same carbon fuel to carbon dioxide. By appropriate adjustment of the primary and second air dampers 22 and 24 complete combustion of the carbonaceous fuel to carbon dioxide is obtained to effectively liberate a high heat output per unit volume of fuel.

The base 12 of the stove 10 has a back wall 40 and right and left side walls 42 and 44, respectively. These walls are solid and as alluded to above, are formed of sheet metal. A front wall 46 is appropriately attached to the right and left side walls 42 and 44. The front wall contains two elongated openings 48 and 50, respectively, which serve as the primary air inlet and the second air inlet, respectively.

A bottom wall 52 is appropriately attached to the back, right, left and front walls 40, 42, 44 and 46 with rivets or the like as shown in the figures. The bottom wall 52 is spaced upwardly from the supporting surface on which the stove 10 sits. This results in contact of the stove 10 with the supporting surface only at the perimeters of the back, right, left and front walls, 40, 42, 44 and 46. This minimizes conduction of heat from these walls to the support surface. It also provides for a small air space between the bottom wall 52 and the support surface to help insulate the support surface from the heat of the stove 10. A top wall 54 completes the exterior of the base 12. The top wall 54 is appropriately joined to the back, right, left and front walls 40, 42, 44 and 46.

Figure 2:
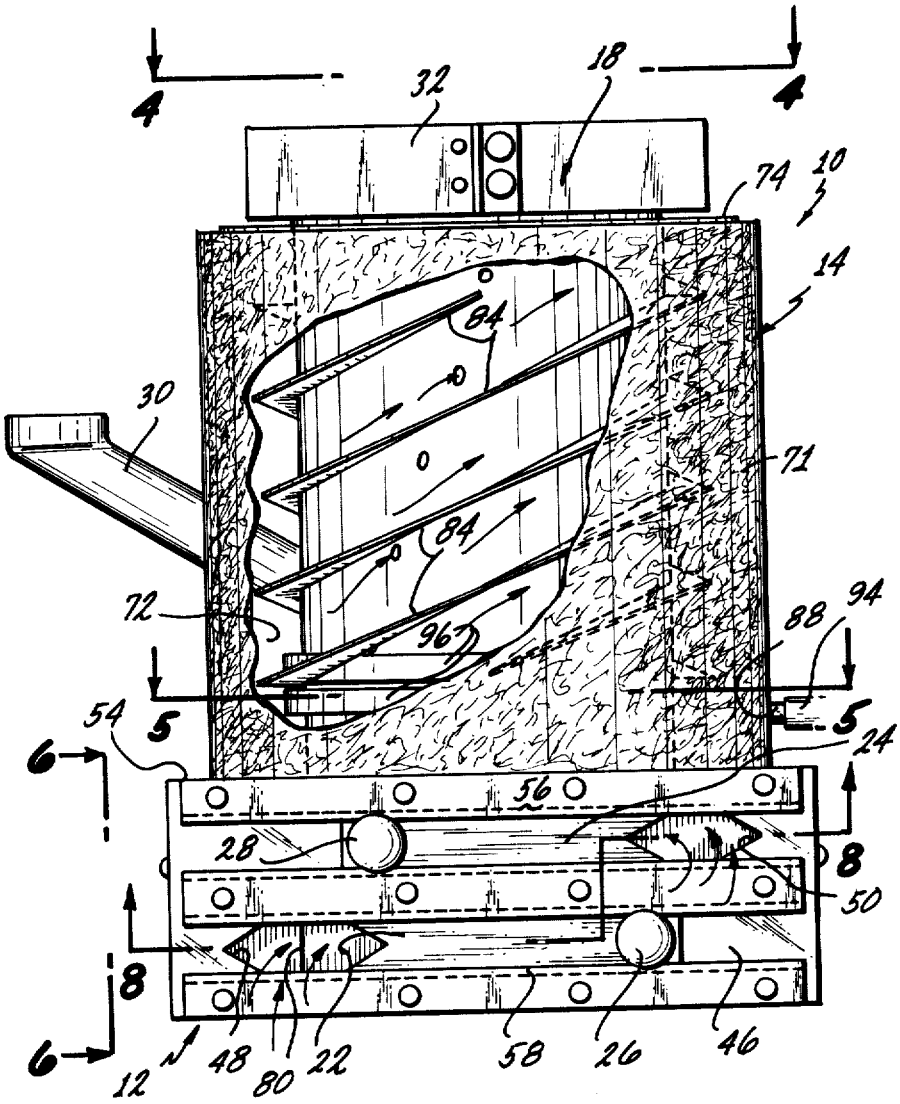
FIG. 2 is a front elevational view of the heating device of FIG. 1.
Figure 4:
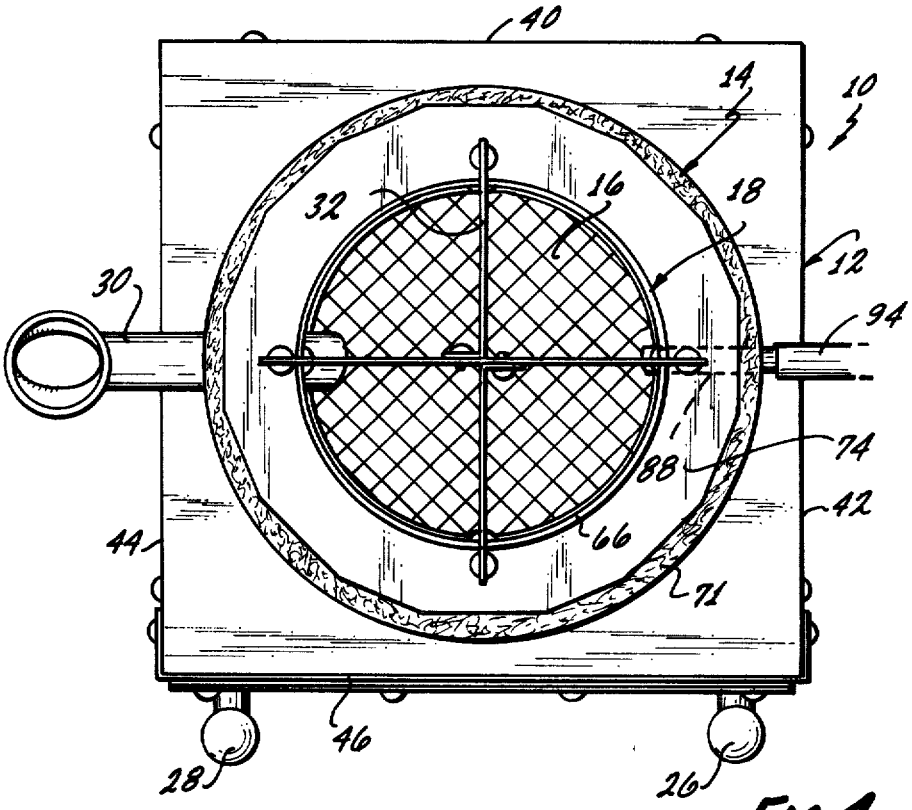
FIG. 4 is a top plan view of the device shown in FIG. 1.

Along the edge where the top wall 54 and the edge where the bottom wall 52 join the front wall 46 are an upper slide lip 56 and a lower slide lip 58 respectively. A slide guide 60 is positioned between the primary air inlet 48 and the secondary air inlet 50 on the wall 46. The primary air damper 22 slides between the lower slide lip 58 and the slide guide 60 as is seen in FIG. 6 and the secondary air damper 24 slides beneath the upper slide lip 56 and the upper edge of the slide guide 60 also as seen in FIG. 6. This provides for a convenient and easily formed system to hold the dampers 22 and 24 onto the base 12, yet allows for easy manipulation of them back and forth to govern the size of the openings of primary and secondary inlets 48 and 50 respectively. As is seen in FIG. 2 the side edges of the inlets 48 and 50 as well as the side edges of the dampers 22 and 24 are cut with a V shape therein. This allows for overlap of the V shapes in these respective surfaces as the dampers are closed to form small diamonds which decrease in size as the damper is further closed. This allows for a very fine control of air flowing through both the primary and secondary air inlets 48 and 50.

After continued use of the stove 10 a small layer of ceramic like material formed from the ash of the fuel used in the stove 10 forms on the top surface of the bottom wall 52 directly below the combustion chamber 20. This forms an insulation of the bottom wall 52 helping to insure long life of the bottom wall 52 as well as preventing radiant heat from being lost through this area. This layer of ceramic material can be seen identified by the numeral 62 in FIG. 3.

An interior plate 64 having a central opening located therein is appropriately suspended within the interior of the base 12. The inlet 48 for primary air is located such that it opens below the interior plate 64 whereas the inlet 50 for secondary air is located such that it opens above interior plate 64. The interior plate 64 thus serves to separate the secondary and primary air and directs them in their respective flow patterns within the stove 10. Attaching to the interior plate 64 is a circular, continuous, upstanding wall 66. The wall 66 includes four holes near its bottom end in which are located two cross wires, collectively identified by the numeral 68, which serve as a support for the grate 16. Four small L-shaped brackets, collectively identified by the numeral 70, are utilized to attach the wall 66 to the interior plate 64.

A second wall 71 surrounds wall 66. The second wall 71 is coaxial with wall 66 and is spaced away from it such that a secondary air heat exchange chamber 72 is formed between them. An annular cap ring 74 attaches to the top of both walls 66 and 70 to seal the stop of the secondary air exchange chamber 72. The cap 74 also serves as a support base for the utensil support member 32. The loading tube 30 appropriately passes through an opening, not identified or numbered, in both the wall 71 and the wall 66. Preferably the wall 71 is formed of an insulating material, such as chimney liner or the like. The wall 71 would therefore be of a thicknes in excess of a quarter of an inch or more and as such, its thickness would fully support the loading tube 30 and maintain it in its position. It is desirable that the wall 71 be formed of an insulating material to prevent heat loss from this area and to contain heat within the secondary air heat exchange chamber 72.

Primary air enters through the primary air inlet 48 into a primary air chamber 76. This primary air chamber is formed by bottom wall 52, parts of the back, right, left and front walls 40, 42, 44 and 46 and the bottom side of interior plate 64. Further, that portion of the interior of wall 66 located below the grate 16 also forms a part of this primary air chamber 76. Primary air entering through the primary air inlet 48 contacts the surfaces of these walls and picks up heat from these surfaces. The heat exchange from these surfaces to the primary air is in the most part exchanged between the portion of the wall 66 below the grate 16 and the portion of the bottom wall 52 directly below the combustion chamber 20. The other walls, however, do contribute to heating of the primary air in proportion to the amount of heat which is conducted to them from the combustion chamber 20. As noted above, the combustion chamber 20 is suspended on to the interior plate 64 and thus the majority of the heat transferred to the wall 66 from combustion within the combustion chamber 20 is not propagated to these other surfaces. This tends to retain the majority of the heat of combustion of the fuel within the stove 10. Movement of the primary air across the air inlets 44, 46 and 48 and walls 50 and 52 and the plate 64 as well as the wall 66 serves to cool these components by transferring heat from them to the primary air. This both serves to increase the longevity of the materials of these walls as well as to increase the efficiency of combustion by preheating the primary air.

Secondary air enters through the secondary air inlet 50 into a secondary air chamber 78 which is continuous with the secondary air heat exchange chamber 72. The secondary air exchange chamber 72 is formed by the exterior surface of wall 66, the interior surface of wall 70 as noted above, as well as the upper surface of interior plate 64 and portions of the back, right, left and front walls 40, 42, 44 and 46 respectively. Movement of secondary air across these walls and surfaces also serves to cool these surfaces in the manner noted above for the primary air. Further, the secondary air is preheated by absorbing heat from these surfaces. Most of the preheating of the secondary air occurs along the exterior surface of the wall 66 as the secondary air moves across this surface in moving up through the secondary air chamber 78 and the secondary air heat exchange chamber 72.

In the embodiment shown in FIG. 3 it can be seen that the grate 16 is located at a position almost coplanar with the top wall 54. This location is not mandatory and the grate 16 could be positioned higher or lower within the combustion chamber 20. If the grate 16 was positioned higher within the combustion chamber 20 there would be a greater portion of the wall 66 located below the grate to serve as preheating surfaces for both the primary and secondary air and conversely, if the grate 16 was located lower within the combustion chamber 20 there would be a lesser amount of the surfaces of wall 66 to serve as preheating surfaces for the primary and secondary air.

Figure 8:
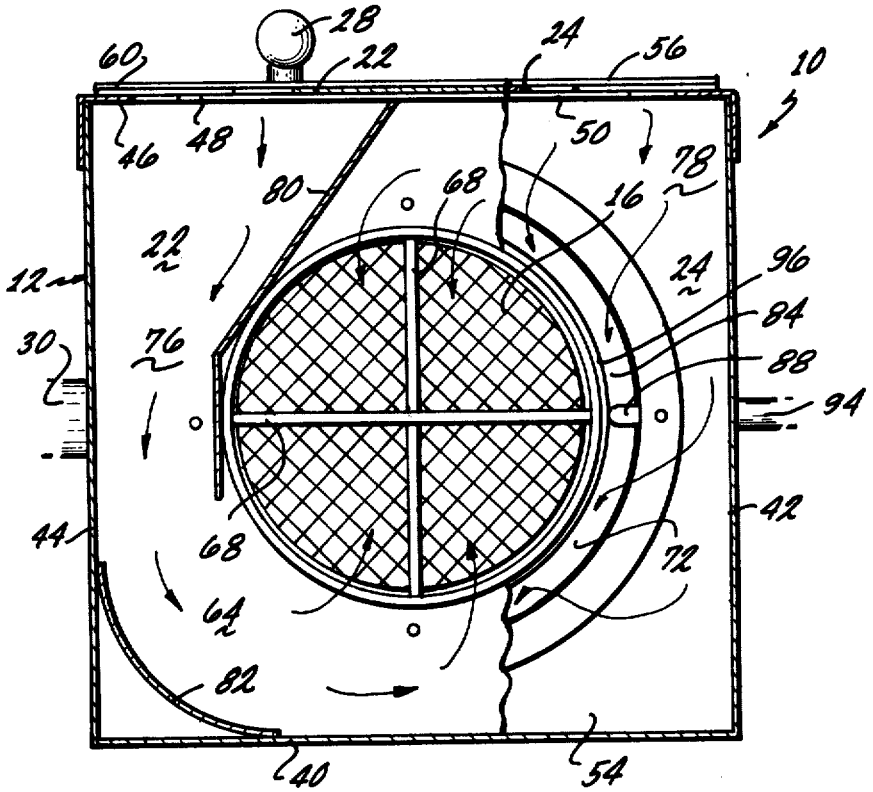
FIG. 8 is a bottom plan view in partial section about the line 8—8 of FIG. 2.

Two baffles 80 and 82 can be located within the primary air chamber 76 to induce a torsional flow component to the primary air moving within this primary air chamber. Baffle 80 as best seen in FIG. 8 is located such that air flowing through the primary air inlet 48 is conducted toward baffle 82 and in concert these two baffles induce a torsional flow component to the primary air moving within the primary air chamber 76. As the air moves around the primary air chamber 76 and up into the area within the wall 66 below the grate 16 the torsional flow component so introduced into the primary air serves to increase the efficiency of combustion by increasing the time of contact between the primary air and the interior surfaces of the primary air chamber 76 such that more heat can be transferred to the primary air as well as insuring flow of primary air through the totality of the grate 16 and thus contacting fuel which is located at diverse positions on the grate 16.

Additionally, a torsional component can be introduced into the secondary air moving through the secondary air heat exchange chamber 72 by the incorporation of a plurality of baffles collectively identified by the numeral 84. These baffles are essentially helical in shape and spiral upwardly through the secondary air heat exchange chamber. A plurality of passageways or holes 86 are formed in wall 66 above the grate 16. These serve as openings for movement of secondary air from the secondaery air heat exchange chamber 72 into the combustion chamber 20. As can be seen in FIG. 3, these passageways 86 are spaced in a pattern allowing for introduction of secondary air into the combustion chamber 20 at a variety of positions and points. This insures even distribution of the secondary air into the combustion chamber 20. During actual operation of the stove 10 depending upon the particular fuel utilized therein, if the fuel is such that it gives off volatile gases which are combustible, jets of flame can be seen issuing from each of the passageways 86 as the preheated secondary air and the combustible gases contact and ignite within the combustion chamber 20.

Both primary and secondary air are conveyed upwardly through the stove 10 by the reduction in density in this air as it is heated in contacting the surfaces noted above. Preheating of this air to 400° F. by such a contact reduces its density from about 0.075 pounds per cubic foot to about 0.06 pounds per cubic foot. This is sufficient to cause an induced self-draft of primary air up through the interior of wall 66 through the grate 16 and through the combustion chamber 20 and of secondary air up through the secondary air heat exchange chamber 72, and through the passageways 86 into the combustion chamber 20. Because of the induced self-draft of the stove 10 no external forced draft devices are necessary in utilizing the stove 10.

Depending on the fuel utilized, the weight/weight ratio of the air needed to burn one pound of fuel is generally in excess of 10 pounds of air per pound of fuel. For certain fuels, such as pure octane, this can increase up to 15 pounds of air necessary for one pound of fuel. It is thus evident that adequate combustion air must be supplied to the fuel in order to obtain efficiency in combusting this fuel. By providing the stove 10 with both primary and secondary air, adequate air is available for efficient burning of the fuel.

Certain fuels, such as wood, produce a large amount of combustible gases per pound of fuel. As the wood burns faster and thus hotter, more of this combustible gas is released. In order to effectively utilize the heat content in these combustion gases it is sometimes desirable to reduce the rate of combustion within the stove 10. By equipping the stove 10 with a tube 88 which is located within the chamber 72 and passes through the wall 66 near its upper end 18, an efficient water spray system can be adapted for use with the stove 10 which is highly utilitarian, yet simple and automatic in operation.

The tube 88 passes through the wall 66 and bends downwardly such that the opening 90 located in the end thereof is directed toward the grate 16. The lower end of the tube 88 passes out through the wall 71 and is connected to a water reservoir 92 via a flexible tube 94. The flexible tube 94 allows for the positioning of the water reservoir 92 and the water therein at a variable level with respect to the opening 90, such that fine control in regulating the rate of combustion within the stove 10 can be achieved.

Not shown in the drawings or forming a part of this specification is a suitable holding device for the water reservoir 92 to adjust its level. Anything from a pile of bricks to a clamping device would be suitable for maintaining the water reservoir 92 at an appropriate height. Heat within the secondary air exchange chamber 72 is transferred to the tube 88 and will cause any water located therein to be heated and eventually boil. Boiling of this water causes the water to spit out of the end 90 in a spray down on to the fuel to reduce its rate of combustion. This process can be augmented by including one or more heat absorbing rings, collectively identified by the numeral 96, within the secondary air heat exchange chamber 72. Preferably the heat absorbing rings 96 are spaced away from the wall 66 and are not in direct contact therewith. If the heat exchange rings 96 are in direct contact with the wall 66 a greater amount of heat is conducted away from the wall 66 than is necessary to control the rate of combustion within the stove 10. In any event, the heat absorbing rings 96 absorb heat from within the chamber 72.

The tube 88 is appropriately attached to the heat absorbing rings 96 in such a manner that heat is conducted from the heat absorbing rings 96 to the tube 88. Since the tube 88 contains a fluid—water—which is at a temperature below 212° F., the heat will flow from the heat exchange rings 96 to the tube 88, and to the water until the water boils at the 212° F. temperature. Upon boiling, the steam so produced induces water to percolate out of the end 90 of the tube 88 downwardly onto the fuel reducing the temperature of the fuel and therefore reducing the rate of combustion. Changing the water level within the tube 88 by changing the level of the water reservoir 92 will change the amount of water percolated out of the end 90 and thus serves as a control means for controlling the rate of cooling of the combustion process within the combustion chamber 20. The heat exchange rings 96 will be formed of a suitable heat conducting material such as copper or the like. The tube 88 could be insulated above where it contacts the heat absorbing rings 96 such that heat conducted to the tube 88 serves to boil the water therein and not to preheat air circulating against the outside of the tube 88. Water will rhythmically be vented out of the opening 90 at a rate of one or two cycles per second during operation of this portion of the invention.

It is of course evident that the baffles 84 could serve as the heat absorbing rings 96; however, this is not the preferred form of the invention in that generally the baffles 84 being in direct contact with the wall 66 would conduct too much heat away from the wall 66 to the tube 88.

From the above description it is evident that the only moving parts of the stove 10 are the dampers 22 and 24 and these move under the influence of the operator of the stove by simply sliding the same. The provision of the stove 10 wherein both primary and secondary air is preheated by certain components of the stove 10 serves to increase both efficiency of operation in combusting the fuel and to insure longevity of parts by maintaining them cooler than they would be without withdrawal of heat from them by both the primary and secondary air. The stove 10 can conveniently burn just about any carbonaceous fuel. The use of the grate 16 allows for convenient burning of solid fuel and by simply inserting a shallow dish full of sand as noted above the stove 10 can conveniently utilize a liquid fuel. Other modifications as provided about serve to allow the stove 10 to conveniently burn gaseous fuel also.

The stove 10 is lightweight and thus portable and could effectively serve as an emergency stove in situations where other means of cooking and heating have been curtailed. Additionally, because of its simplicity of construction as well as the economics of its material and construction this stove 10 can be utilized in certain areas of the world wherein underdevelopment, overpopulation, or scarcity of fuel detracts from the quality of life of the inhabitants of these areas.

By substituting a ceramic or glass material for the insulating material utilized for the wall 71 the stove 10 can effectively serve as a space heater as well as a cooking stove. The stove 10, however, can be used as a space heater even with utilization of an insulating material for this second wall 71 by virtue of the hot gases produced by the stove 10. Because of the utilization of both primary and secondary air in the stove 10 the products of combustion of the stove 10 tend to be depleted in carbon monoxide and thus utilization of a space heater is not precluded because of this aspect.

In place of the primary air damper 22 an ash drawer could be substituted. It would slide into the primary air chamber 76. Such a drawer would have an open top for collecting ash falling down from the grate 16. Control of primary air flow would be achieved by opening or closing this drawer. The more this drawer is withdrawn out of the primary air chamber 76 the greater the gap or opening formed between its front end and front wall 46. Closing the drawer would serve to close the gap reducing primary air flow. While in the preferred embodiment shown in the figures the walls 66 and 70 are shown as solid, one-piece walls, they also could be formed in segments which would fit one around the other to form telescoping walls such that when not in use the stove 10 could be folded into a more compact unit.

A removable cap 98, as shown in FIG. 3, can be located over the external opening of the loading tube 30 to prevent heat loss or flames issuing out of the external opening of the loading tube 30 when it is not being utilized for introducing fuel into the combustion chamber 20.

I claim:

1. A carbonaceous fueled heating device which comprises:

a base;

a vertically oriented continuous heat conduction metalllic wall located on said base with a portion of said metallic wall located above said base and the remaining portion of said metallic wall located within and enclosed by said base, said metallic wall having continuous interior and exterior surfaces, said metallic wall having open top and bottom ends, said top end opening to the ambient environment so as to discharge heat to the ambient environment through said top end;

an air permeable grate located within said wall upwardly displaced from said bottom end of said wall so as to divide the space enclosed by the interior surface of said metalllic wall into a combustion chamber located above said grate and a primary heat exchange chamber located below said grate;

a primary air supply means located in said base below said combustion chamber, said primary air supply means including a primary air chamber and a primary air inlet, said primary air inlet opening between the ambient environment and said primary air chamber whereby air from the ambient environment is admitted into said primary air chamber through said primary air inlet, said bottom end of said metallic wall opening into said primary air chamber with the portion of the interior surface of said metallic wall which is located between said bottom end and said grate serving as a heat exchanger to heat air within said primary heat exchange chamber whereby air flowing through said primary air inlet into said primary air chamber is preheated within said primary heat exchange chamber prior to passage through said grate;

a secondary air supply means, said secondary air supply means including said exterior surface of said metallic wall and further including a continuous second wall spaced away from and continuously surrounding said portion of said metallic wall which is located above said base, said secondary air supply means further including an imperforate cap wall located on the top of and extending between said metallic wall and said second wall, together said exterior surface of said metallic wall, said second wall and said cap forming a secondary heat exchange chamber;

said secondary air supply means further including a secondary air inlet, said secondary air inlet opening between the ambient environment and said secondary heat exchange chamber;

said metallic wall between said top end and said grate including a plurality of air passageways between said secondary heat exchange chamber and said combustion chamber, said air passageways arranged in an array extending around said combustion chamber and vertically spaced from one another along the height of said combustion chamber from a position proximal to said grate to said top end of said metallic wall whereby air admitted into said secondary heat exchange chamber through said secondary air inlet prior to flowing into said combustion chamber through said passageways is heated by heat conducted from said combustion chamber by said metallic wall;

together said second wall and said base completely enclosing said metallic wall so as to inhibit heat loss from said metallic wall directly to the ambient environment.

2. The heating device of claim 1 wherein:

said second wall is formed of an insulating material generally capable of retarding transfer of heat through itself.

3. The heating device of claim 1 wherein:

said primary air inlet includes a primary damper means capable of regulating the flow of air between the ambient environment and said primary air chamber.

4. The heating device of claim 3 wherein:

said second wall is formed of an insulating material generally capable of retarding transfer of heat through itself.

5. The heating device of claim 3 wherein:

said secondary air inlet includes a secondary damper means capable of regulating the flow of air between the ambient environment and said secondary heat exchange chamber.

6. The heating device of claim 5 wherein:

said metallic wall and said second wall are both cylindrical in shape and are coaxial with each other.

7. The heating device of claim 6 including:

a primary baffle means located in said primary air chamber and capable of introducing a torsional flow component into the air moving within said primary air chamber from said primary air inlet.

8. The heating device of claim 6 including:

a secondary baffle means located in said secondary heat exchange chamber and capable of introducing a torsional flow component into air moving within said secondary heat exchange chamber.

9. The heating device of claim 8 including:

a heat conducting tube means, at least a portion of which is vertically located within said secondary heat exchange chamber and at least a portion of which extends through said metallic wall into said combustion chamber proximal to said top end of said metallic wall;

water supply means connected to said tube means to supply water into the interior of said tube means;

heat absorbing means located within said secondary heat exchange chamber and attached to said tube means such that heat is conducted from said secondary heat exchange chamber to said tube means;

said heat absorbing means comprises at least one heat absorbing ring located in said secondary heat exchange chamber.

10. The heating device of claim 6 including:

a heat conducting tube means, at least a portion of which is vertically located within said secondary heat exchange chamber and at least a portion of which extends through said metallic wall into said combustion chamber proximal to said top end of said metallic wall;

water supply means connected to said tube means to supply water into the interior of said tube means;

heat absorbing means located within said secondary heat exchange chamber and attached to said tube means such that said heat is conducted from said secondary heat exchange chamber to said tube.

11. The heating device of claim 10 wherein:

said heat absorbing means comprises at least one heat absorbing ring located in said secondary heat exchange chamber.

12. A carbonaceous fueled heating device which comprises:

a base;

a vertically oriented continuous heat conduction metallic wall located on said base with a portion of said metallic wall located above said base and the remaining portion of said metallic wall located within and enclosed by said base, said metallic wall having continuous interior and exterior surfaces, said metallic wall having open top and bottom ends, said top end opening to the ambient environment so as to discharge heat to the ambient environment through said top end;

an air permeable grate located within said wall upwardly displaced from said bottom end of said wall so as to divide the space enclosed by the interior surface of said metallic wall into a combustion chamber located above said grate and a primary heat exchange chamber located below said grate;

a primary air supply means located in said base below said combustion chamber, said primary air supply means including a primary air chamber and a primary air inlet, said primary air inlet opening between the ambient environment and said primary air chamber whereby air from the ambient environment is admitted into said primary air chamber throgh said primary air inlet, said bottom end of said metallic wall opening into said primary air chamber with the portion of the interior surface of said metallic wall which is located between said bottom end and said grate serving as a heat exchanger to heat air within said primary heat exchange chamber whereby air flowing through said primary air inlet into said primary air chamber is preheated within said primary heat exchange chamber prior to passage through said grate;

a secondary air supply means, said secondary air supply means including said exterior surface of said metallic wall and further including a continuous second wall spaced away from and continuously surrounding said portion of said metallic wall which is located above said base, said secondary air supply means further including an imperforate cap wall located on the top of and extending between said metallic wall and said second wall, together said exterior surface of said metallic wall, said second wall and said cap forming a secondary heat exchange chamber;

said secondary air supply means further including a secondary air inlet, said secondary air inlet opening between the ambient environment and said secondary heat exchange chamber;

said metallic wall between said top end and said grate including a plurality of air passageways between said secondary heat exchange chamber and said combustion chamber, said air passageways arranged in an array extending around said combustion chamber and vertically spaced from one another along the height of said combustion chamber between said grate and said top end of said metallic wall whereby air admitted into said secondary heat exchange chamber through said secondary air inlet prior to flowing into said combustion chamber through said passageways is heated by heat conducted from said combustion chamber by said metallic wall;

together said second wall and said base completely enclosing said metallic wall so as to inhibit heat loss from said metallic wall directly to the ambient environment;

a heat conducting tube means, at least a portion of which is vertically located within said secondary heat exchange chamber and at least a portion of which extends through said wall into said combustion chamber proximal to said top end of said wall;

water supply means connected to said tube means to supply water to the interior of said tube means.

13. The heating device of claim 12 wherein said water supply means includes a water reservoir means and a connecting means, said connecting means connecting said reservoir means to said tube means and capable of conducting fluid between said water reservoir means and said tube means;

said water reservoir means capable of holding a quantity of water and being adjustable with respect to said tube means such that the water level within said tube means is dependent upon the water level within said water reservoir means.

14. The heating device of claim 13 including:

heat absorbing means located within said secondary heat exchange chamber and attached to said tube means such that heat is conducted from said secondary heat exchange chamber to said tube means.

* * * * *

UNITED STATES PATENT AND TRADEMARK OFFICE

CERTIFICATE OF CORRECTION

PATENT NO. : 4,471,751

DATED : SEPTEMBER 18, 1984

INVENTOR(S) : FRED W. HOTTENROTH et al

It is certified that error appears in the above-identified patent and that said Letters Patent is hereby corrected as shown below:

Column 1, line 15 "effective" should read --an effective--.

Column 2, line 63 "exchanger" should read --exchange--.

Column 5, line 15 eliminate the words "might not be" and insert the word --is--.

Column 6, line 17 "inefficiently" should read --inefficient--.

Column 7, line 36 "thicknes" should read --thickness-.

Column 7, line 65 and 66 "inlets 44, 46 and 48" should read --inlets 48 and 50--.

Column 7, line 66 "walls 50 and 52" should read --walls 52 and 54--.

Column 8, line 9 "70" should read --71--.

Column 8, line 61 "secondaery" should read --secondary--.

Column 9, line 11 "0.06" should read --0.05--.

Column 11, line 15 "70" should read --71--.

Column 13, line 53, "throgh" should read --through--.

Signed and Sealed this

*Twenty-third* Day of *July 1985*

[SEAL]

*Attest:*

DONALD J. QUIGG

*Attesting Officer* *Acting Commissioner of Patents and Trademarks*